United States Patent [19]

Ruether

[11] Patent Number: 4,735,706

[45] Date of Patent: Apr. 5, 1988

[54] PROCESS AND APPARATUS FOR COAL HYDROGENATION

[75] Inventor: John A. Ruether, McMurray, Pa.

[73] Assignee: The United States of America as represented by the United States Department of Energy, Washington, D.C.

[21] Appl. No.: 867,124

[22] Filed: May 27, 1986

[51] Int. Cl.[4] ..... C10G 1/00; B01J 2/06; C10L 5/16

[52] U.S. Cl. ..... 208/426; 44/24; 208/408

[58] Field of Search ..... 208/426, 420, 429, 409, 208/415, 430, 435; 44/24, 10 R, 16 R, 12 J

[56] References Cited

U.S. PATENT DOCUMENTS

| | | | |
|---|---|---|---|
| 2,609,331 | 9/1952 | Cheney | 208/426 X |
| 2,753,296 | 7/1956 | Sellers | 208/426 |
| 3,152,063 | 10/1964 | Schroeder et al. | 208/420 |
| 3,321,393 | 5/1967 | Schuman et al. | 208/426 X |
| 4,021,206 | 5/1977 | Huberts et al. | 44/24 X |
| 4,111,787 | 9/1978 | Aldridge et al. | 208/420 X |
| 4,133,742 | 1/1979 | Hill | 208/426 |
| 4,153,419 | 5/1979 | Clayfield et al. | 44/24 X |
| 4,294,584 | 10/1981 | Verschuur | 44/24 X |
| 4,309,190 | 1/1982 | Baron et al. | 44/16 R |
| 4,403,996 | 9/1983 | Matsuura et al. | 208/426 X |
| 4,422,246 | 12/1983 | Hardesty et al. | 44/10 J |
| 4,571,294 | 2/1986 | Friedman et al. | 208/426 |

*Primary Examiner*—Helen M. S. Sneed
*Assistant Examiner*—Glenn Caldarola
*Attorney, Agent, or Firm*—Earl L. Larcher; Stephen D. Hamel; Judson R. Hightower

[57] ABSTRACT

In a coal liquefaction process an aqueous slurry of coal is prepared containing a dissolved liquefaction catalyst. A small quantity of oil is added to the slurry and then coal-oil agglomerates are prepared by agitation of the slurry at atmospheric pressure. The resulting mixture of agglomerates, excess water, dissolved catalyst, and unagglomerated solids is pumped to reaction pressure and then passed through a drainage device where all but a small amount of surface water is removed from the agglomerates. Sufficient catalyst for the reaction is contained in surface water remaining on the agglomerates. The agglomerates fall into the liquefaction reactor countercurrently to a stream of hot gas which is utilized to dry and preheat the agglomerates as well as deposit catalyst on the agglomerates before they enter the reactor where they are converted to primarily liquid products under hydrogen pressure.

8 Claims, 1 Drawing Sheet

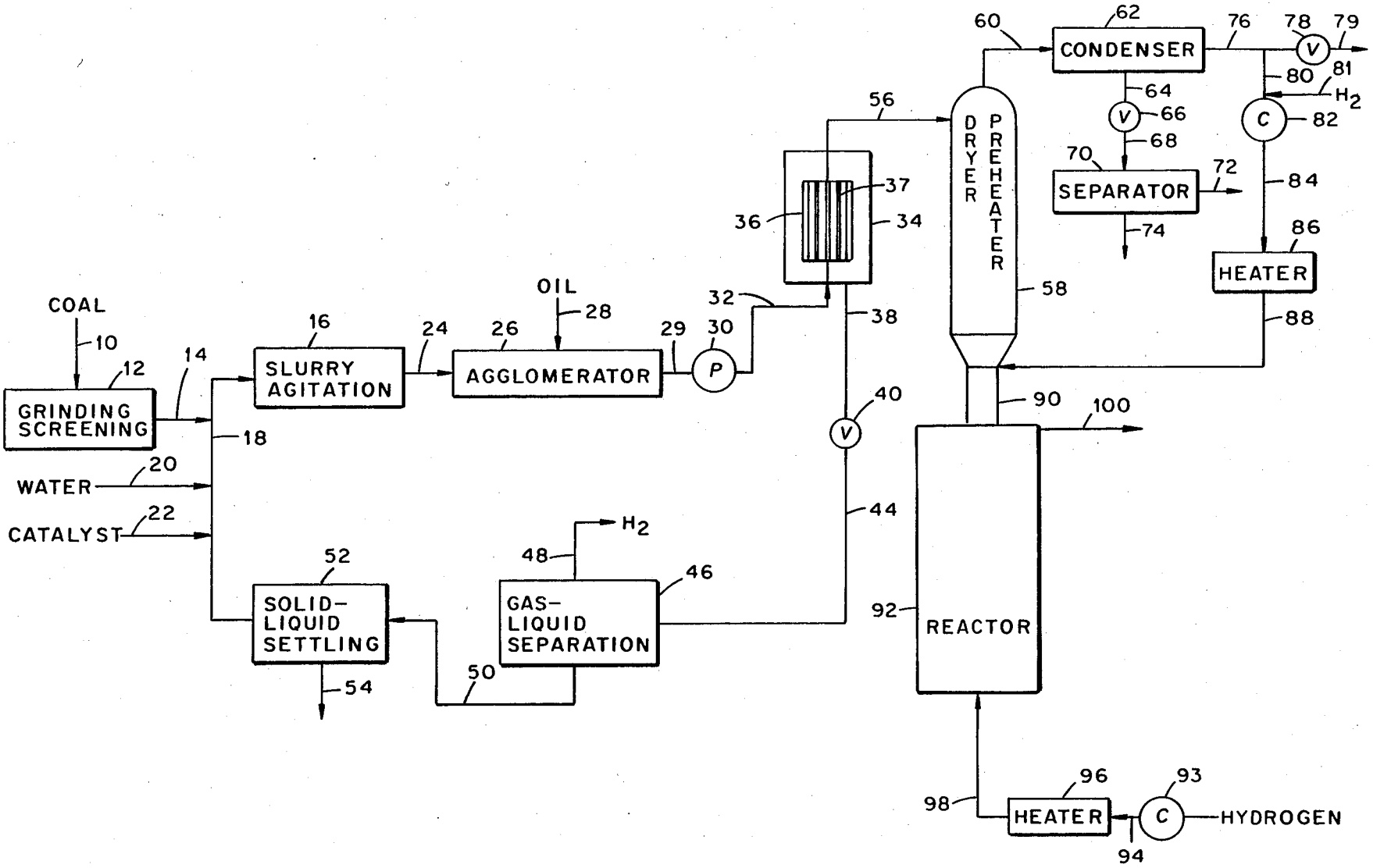
COAL
GRINDING SCREENING
WATER
CATALYST
SLURRY AGITATION
OIL
AGGLOMERATOR
GAS-LIQUID SEPARATION
SOLID-LIQUID SETTLING
DRYER
REACTOR
CONDENSER
SEPARATOR
HEATER
HEATER
HYDROGEN
H2
H2

PROCESS AND APPARATUS FOR COAL HYDROGENATION

BACKGROUND OF THE INVENTION

The present invention relates generally to a method and apparatus for the hydrogenation or liquefaction of coal, and more particularly to such a method and apparatus capable of continuously converting coal particulates to primarily liquid hydrocarbon products by providing an aqueous pumpable slurry containing coal and a water soluble catalyst, forming agglomerates of the coal with the aid of added oil, separating essentially all the water from the agglomerates by passing the agglomerates through a drainage means followed by a dryer and preheater, and then passing the dried and preheated agglomerates into a reactor where they are hydrogenated.

In continuous direct coal liquefaction processes as previously known, pulverized coal is fed into the process as a slurry formed of coal particles and a solvent provided by recycling a portion of the coal liquefaction product. The coal slurry is usually pressurized by a pump, passed through a preheater and then into a reactor where the coal is converted to liquid and gaseous products under the influence of elevated temperature and hydrogen pressure. These previous processes are generally disclosed in U.S. Pat. Nos. 3,519,555; 3,700,584; 3,791,957; 4,089,658; and 4,111,788. The maximum solids content of the feed slurry in such previous processes is limited to slightly more than 40 weight percent since with greater solids content the slurry becomes so viscous as to be unpumpable. The use of such relatively large concentrations of solvent with the feed coal is disadvantageous in that it is wasteful of energy since the solvent must be heated to reaction temperature along with the coal and is also wasteful of the interior volume of process equipment in that only about 50 percent or less by volume of the feed slurry consists of coal. Thus, it is desirable to have an alternative method to the conventional coal/solvent slurry for feeding coal to a liquefaction process.

It is also known within the art that an efficient method for introducing catalysts into a coal liquefaction system is through impregnation from solution. The catalysts are often salts of transition metals such as iron, molybdenum, nickel or tin. If water-soluble salts are used, the catalysts may be impregnated from an aqueous solution. Compared to other methods of catalyst addition, impregnated catalysts are efficacious at small concentrations, which is thought to be due to the highly dispersed nature of the catalysts within the coal particles and the proximity of catalysts to reactive sites in the coal. The use of catalyst impregnation in continuous liquefaction processes has been limited to date due to the expense of drying coal after impregnation and prior to charging a coal-solvent slurry to the process.

The direct liquefaction of coal in the presence of large amounts of water is also known in the art. Batchwise reactions have been carried out using ratios of coal-to-water that could be obtained from a pumpable slurry of coal and water as described in several papers published in the Proceedings of the 1985 International Conference on Coal Science (Pergamon Press) which are entitled "Oxygen Loss and Conversion of Coal" by Ross and Hum, "Novel Liquefaction Solvent; $H_2O$-$H_2S$" by Stenberg and Nowak, and "Prospects for Coal Liquefaction Using an Aqueous Feed Stream" by Ruether et al. A major disadvantage to carrying out liquefaction in the presence of large quantities of water is due to the contribution of the vapor pressure of water to the total system pressure. Typically such liquefaction is carried out at a total pressure in the vicinity of 4,000 psig or higher which is not economically attractive. Thus, to the present time there is no commercially attractive method for liquifying coal that uses an aqueous feed slurry.

SUMMARY OF THE INVENTION

From the foregoing, it can be seen that water provides a satisfactory medium for pumping a feed slurry of coal to a reaction pressure if essentially all the water can be removed prior to introduction of the coal into the reactor. In accordance with the present invention, it has been found that this water removal can be accomplished in part by using oil agglomeration of coal as described in U.S. Pat. Nos. 4,021,206; 4,153,419; and 4,257,879; and in a publication entitled "Coal Preparation" by C. E. Capes, published by the American Institute of Mining, Metallurgical and Petroleum Engineers, New York (1979). To prepare coal/oil agglomerates, an aqueous slurry of pulverized coal is mixed with a small amount of oil which is typically in the range of about 5 to 35 weight percent of the dry coal. After a suitable period of agitation the coal is formed into agglomerates which have favorable properties for use as a feed to a coal liquefaction process. Mineral matter present in the coal is rejected to the water phase so that the coal-oil agglomerates are concentrated in organic matter.

Coal-oil agglomerates may be prepared in a size range of less than 1 millimeter (mm) to greater than 1 centimeter in diameter. Agglomerates in a size range of about 1 to 4 mm are preferred for use in the present invention. With agglomerates in this size range, most of the water present during agglomerate formation can be removed by a simple draining step. The moisture content of the drained agglomerates is in a range of about 8 to 20 percent by weight of the dry coal in the agglomerates. The concentration of catalyst desired for the coal fed to the reactor can be readily provided by incorporating a water soluble catalyst in the coal slurry used to prepare the agglomerates. The water soluble catalyst adheres to the coal particles when the water is evaporated from the agglomerates before they are fed into the reactor.

In the present invention the only vehicle accompanying the feed coal into the reactor is provided by the binder oil used to form the agglomerates. Because this fraction of oil in the feed coal is so small, the process is thermally efficient for preheating the coal feed. Coal-oil agglomerates that have been drained to a moisture content of about 8 to 20 percent are allowed to free fall into the reactor countercurrent to a stream of hot gas (primarily hydrogen) and introduced into the dryer-preheater. The hot gas dries the agglomerates, leaving the desired concentration of impregnated catalyst. The hot gas also preheats the agglomerates prior to their dropping into the reactor. The heat of reaction of hydrogen with coal in the reactor is used to provide much of the heat necessary to bring the agglomerates up to reaction temperature.

Generally, the practice of the present invention is directed to the method for the hydrogenation of coal at a pressure substantially greater than atmospheric pressure and at elevated temperatures in the presence of a catalyst to convert the coal to hydrocarbon liquids and gases. The method comprises the steps which include the preparation of an aqueous slurry of coal particulates, a water-soluble catalyst, and water. The water is in a sufficient amount to dissolve the catalyst so that the catalyst can be subsequently deposited upon the surface of the coal particulates. Agglomerates of the coal particulates are then formed from the slurry by adding to the slurry an adequate concentration of oil to form the agglomerates upon sufficient agitation of the slurry. The resulting slurry containing the agglomerates, water, and unagglomerated solids is pumped to a pressure of at least about 1000 psig. The agglomerates are then separated from the unagglomerated solids and excess water and thereafter conveyed by gravitational forces or dropped through a dryer-preheater into a reactor. The agglomerates dropping through the dryer-preheater are contacted in a countercurrent manner with a stream of hot gas consisting essentially of hydrogen. The hot gas dries the agglomerates, effects the deposition of the catalyst onto the surface of the coal particulates and preheats the coal to a temperature of at least about 200° C. These preheated agglomerates dropping into the reactor are heated to a temperature of at least about 340° C. and subjected to a pressure of at least about 1000 psig while being contacted therein with reaction liquids and hot gas consisting essentially of hydrogen to effect the hydrogenation of the coal particulates.

As will be described in greater detail below, the catalyst is provided by a water-soluble transition metal salt. The oil used for forming the agglomerates is preferably process-derived oil in a concentration of about 10 to 35 percent by weight of the dry coal. The agitation used is any suitable stirring mechanism capable of causing agglomerates in the size range of about 1 to 4 mm to form. The agglomerates, free or excess water, and the unagglomerated solids including coal particulates and mineral matter are pumped to the reaction pressure in the range of about 1000 to 3500 psig. The pumped mixture is then conveyed through drain means which retains tne agglomerates while passing the water and unagglomerated solids. The separated agglomerates fall through a dryer-preheater while being contacted witn an upward flowing stream of hot gas consisting primarily of hydrogen to effect the drying of the agglomerates, the deposition of the catalyst onto the agglomerates, and the preheating of the agglomerates to a temperature in a range of about 190° to 350° C. The preheated agglomerates then fall into a suitable hydrogenation reactor, preferably a bubble column reactor, through which hot hydrogen is passed. The coal in the agglomerates reacts in the presence of the hot hydrogen to form liquid and gaseous products in a reaction medium containing hydrogen dissolved in coal liquids from previously reacted coal feed. Residence time of the coal feed in the reactor is in the range of about 15 to 90 minutes at a temperature in a range of about 340° to 450° C. Hydrogen which may optionally contain some hydrogen sulfide is fed into the reactor at a flow rate in the range of about 0.33 to 3.3 standard liters hydrogen per gram of dry coal. This hydrogen is passed through a preheater prior to entering the reactor for heating the hydrogen to a temperature sufficient to effect the desired hydrogenation reaction. A recycle loop for hydrogen gas is also used for drying and partial preheating of the agglomerates in the dryer.

Solid, liquid, and gaseous reaction products are discharged from the reactor in the upper zone thereof. The reactor preferably contains a suitable baffle arrangement which is capable of preventing agglomerates from short circuiting the desired flow path through the reactor and thereby being prematurely discharged from the reactor. The dryer-preheater is maintained at a slightly higher pressure than the reactor to prevent gases from the reactor from entering the dryer-preheater.

BRIEF DESCRIPTION OF THE DRAWING

The FIGURE is a schematic representation of apparatus utilized for practicing the present invention.

A preferred embodiment of the invention has been chosen for the purpose of illustration and description. The preferred embodiment illustrated is not intended to be exhaustive or limit the invention to the precise form disclosed. It is chosen and described in order to best explain the method and principles of the invention and their application in practical use to thereby enable others skilled in the art to best utilize the invention and various embodiments and modifications as are best adapted to the particular use contemplated.

DEATILED DESCRIPTION OF THE INVENTION

With reference to the drawing, coal such as bituminous sub-bituminous coal is conveyed through a conduit 10 and through a preparation unit 12 where the coal is ground to a desired particulate size of less than 60 mesh (U.S. Mesh) and screened for uniformity. The pulverized coal is passed through conduit 14 into an agitated slurry mixing tank 16. Water and dissolved catalyst provided by a recycle loop, as will be described below, are conveyed through conduit 18 into tank 16 for forming a coal-water slurry of uniform composition. Also added to tank 16 are make-up water and make-up catalyst through conduits 20 and 22, respectively. The ratios of coal-to-water fed into tank 16 are such as to give favorable conditions for forming coal-oil agglomerates and can be satisfactorily accomplished by using a slurry containing about 10 to 40 weight percent dry coal. Also, the feed rate of the make-up catalyst through conduit 22 is such as to give the desired catalyst concentration in tank 16 which depends upon the moisture content of agglomerates downstream in the process and the desired catalyst concentration with the agglomerates used in the hydrogenation reaction.

The catalyst utilized in the present invention is a water-soluble salt of a transition elemental metal. For example, materials such a ammonium tetramolybdate, ammonium paramolybdate, ferrous sulfate hepahydrate, ferrous nitrate hexahydrate, and nickel sulfate and its hydrates are satisfactory for the practice of the present invention. The concentration of molybdenum-containing salts found to be sufficient for effecting desirable coal-to-liquid conversions in a reactor is in the range of about 0.005 to 0.5 weight percent molybdenum expressed as a percentage of dry coal in the agglomerates fed into the reactor. Preferably this range is 0.01 to 0.25 weight percent molybdenum. For iron-containing salts, the concentration is 0.2 to 2.0 weight percent iron. However, any water-soluble catalytic material known in the art may be satisfactorily used in tne practice of the present invention.

The aqueous mixture or slurry of coal and dissolved catalyst leaves the slurry-forming tank 16 via conduit 24 and enters the agglomerate forming vessel 26. Oil is added to vessel 26 through conduit 28 with this oil being added to the vessel 26 in an amount sufficient to produce agglomerates in the preferred size range of about 1 to 4 mm. This agglomeration can be accomplished by the use of oil in the amount of about 10 to 35 weight percent of the weight of the dry coal fed into vessel 26. Agglomeration of the coal may be achieved in the agglomerator vessel by generation of sheer forces through the use of agitaters or any other suitable agitating devices as known in the art. The oil can be conveniently supplied by the process but this is not necessary.

The mixture is discharged from the agglomerator vessel 26 through conduit 29 and consists essentially of agglomerates, free or excess water, dissolved catalyst, and unagglomerated solids consisting primarily of mineral matter. A pump 30 in registry with conduit 29 is used to raise the pressure of the mixture to essentially that in the reactor which is in a range of about 1000 to 3500 psig. The pump 30 may be any suitable mechanical pump such as a piston-type pump. The mixture exits the pump 30 through conduit 32 and enters a containment vessel 34 having therein a sieve-providing conduit 36 for draining excess water and unagglomerated solids from the agglomerate-containing slurry passing through conduit 36. This sieve-providing conduit 36 is vertically oriented and is fashioned from a plurality of wires 37 with wedge-shaped configurations disposed parallel to each other and extending in the direction of flow. The wire wedges 37 together form an annular bundle or cylinder and are provided with spaces between adjacent wires 37 of sufficient size so that water and unagglomerated solids can pass through these spaces while the agglomerates are retained within conduit 36. The wire wedges 37 in the drain conduit 36 are also shaped to avoid plugging or blinding by the agglomerates in a manner similar to that used in a conventional sieve-bend dewatering device.

Water, dissolved catalyst and unagglomerated solids drained from the agglomerates are collected in the bottom of vessel 34 and together with some dissolved gases exit vessel 34 via conduit 38. A valve 40 is disposed in conduit 38 below vessel 34 and is controlled by an automatic liquid level sensor (not shown) in the vessel 34 to maintain the liquid level in the vessel 34 below the bottom of the drain conduit 36. The entire contents of vessel 34 are essentially at the pressure of the reactor and there is no pressure differential across the drain conduit 36. However, the pressure of the material removed from vessel 34 is reduced to essentially atmospheric pressure downstream of valve 40 in conduit 44 by the valve 40 which is constructed to function as an expansion valve, as known in the art. Any hydrogen dissolved in the water discharged from vessel 34 comes out of solution upon the reduction of the pressure in conduit 44. This low pressure mixture passes into a gas-liquid separator 46 where the hydrogen gas exits via conduit 48 for recycle into the process if desired. The solids and water containing dissolved catalyst are conveyed from the separator 46 through conduit 50 to a solid-liquid settling vessel 52. A waste stream of solids consisting primarily of mineral matter is removed from the vessel 52 through conduit 54 while the water containing dissolved catalyst is recycled to the slurry preparation vessel 16 via conduit 18.

The agglomerates discharged from the drain conduit 36 are largely water free and flow through conduit 56 to a vertically oriented agglomerate dryer 58 under the motive force supplied by pump 30. The length of conduit 56 is as short as practical and bends in the conduit are preferrably avoided so as not to impede the flow of agglomerates therethrough. The water content of the agglomerates discharged from the drain conduit 36 is in the range of about 8 to 20 percent by weight dry coal contained in the agglomerates. With this moisture content known the catalyst addition needed to give the desired catalyst concentration in the agglomerates fed into the reactor may be readily determined. When a molybdenum-salt catalyst is employed, catalyst should be added to the slurry tank through conduit 22 so that the catalyst concentration in the slurry is in the range of about 0.005 to 0.125 g molybdenum per g water and make-up catalysts can be added to achieve this range. Calculations for catalyst additions can be made for any of the other catalysts employed.

Upon exiting conduit 56 the agglomerates enter the top of a vertically oriented dryer-preheater 58 and fall freely therethrough with this gravitational flow being in the direction countercurrent to an upward flow of hot gas, primarily hydrogen. A suitable manifold arrangement (not shown) may be disposed in the top of the dryer-preheater 58 so that the agglomerates may be dropped into the dryer-preheater in a uniform pattern across the cross section thereof. The hot gas contacting the agglomerates in the dryer-preheater serves to heat the agglomerates and dry them substantially completely and the resulting moisture-laden gas then exits the dryer-preheater 58 through conduit 60 into a condenser 62. Liquid water containing dissolved gases exits condenser 62 through conduit 64 and the pressure of the liquid is reduced to substantially atmospheric pressure as the liquid passes through a suitable pressure regulating valve 66. The gas-liquid mixture resulting from the pressure drop is introduced into a gas-liquid separator 70 where the gas is separated and discharged through conduit 72 while the water is discharged through conduit 74. If desired, the gas and/or the water may be recycled to appropriate portions of the process.

A gas stream of reduced water content also exits condenser 62 through conduit 76. A portion of this gas stream passes through a pressure regulating valve 78 and leaves the gas recycle loop via conduit 79. The gas bleed stream in conduit 79 acts to keep hydrogen in the gas recycle loop at the desired purity. Make-up hydrogen is added to the gas recycle loop via conduit 81. Recycled plus make-up hydrogen enters recycle compressor 82 via conduit 80. Gas from the compressor 82 is conveyed through conduit 84 to hydrogen heater 86 where the hydrogen is heated to a temperature in the range of about 100° to 500° C, preferably about 200° to 350° C., for drying and preheating the agglomerates in the dryer-preheater 58 without initiating undesired liquefaction reactions. The hot hydrogen is conducted from the heater 86 through conduit 88 into the dryer-preheater 58 at the base thereof.

The temperature of the agglomerates entering reactor 92 is largely controlled by operating parameters of the hydrogen recycle loop consisting principally of dryer-preheater 58, condenser 62, recycle compressor 82, and heater 86. The temperature of the agglomerates leaving dryer-preheater 58 is controlled by manipulation of the hydrogen flow rate in the recycle loop and the temperature of the recycle hydrogen in conduit 88. Conditions in the recycle loop are controlled so that the agglomerates leaving the dryer-preheater 58 and entering the reactor 92 are at a temperature sufficient to support an essentially adiabatic reaction in the reactor 92. The preferred temperature of the preheated agglomerates entering reactor 92 is in the range of about 190° to 300° C.

Hydrogen for the reaction in the reactor 92 may optionally contain some hydrogen sulfide and is compressed in a suitable compressor 93 to the reaction pressure utilized and is fed via conduit 94 into a heater 96 where the hydrogen is preheated to a temperature in the range of about 300° to 500° C. With the use of certain catalysts especially those containing iron, it is desirable to use hydrogen containing about 0.5 to 20.0 mole percent hydrogen sulfide, preferably about 1.0 to 10.0 mole percent hydrogen sulfide. Hydrogen leaves the heater 96 via conduit 98 and enters the lower portion of reactor 92 through a sparger. A hydrogen feed rate in the range of about 0.33 to 3.3 standard liters per g of dry coal feed may be employed. This feed rate is preferably in a range of about 0.45 to 2.2 standard liters per g of dry coal. Reactor temperature is maintained in the range of about 340° to 450° C. with the residence time of the coal in the reactor being about 15 to 90 minutes, preferably 0.25 to 1.0 hour. Temperature in the reactor 92 is controlled by the extent of the preheating of the hydrogen in the heater 96.

A product of liquid and unreacted solids is discharged from the reactor through conduit 100 and can be subjected to any further treatment desired. For example, the present invention is particularly suitable for providing a first-stage liquefaction product that may be upgraded in a second catalytic hydrotreatment stage such as taught in U.S. Pat. Nos. 3,791,957; 4,111,788; and 4,264,429.

Reactor 92 contains a suitable baffle of conventional design (not shown) which is positioned to prevent agglomerates entering reactor 92 from taking a short-circuit path through conduit 100. The baffle causes the coal feed to substantially traverse the length of the reactor 92 in a downward flow direction before changing direction near the bottom of the reactor.

The present invention provides several advantages over previously employed techniques for conducting direct liquefaction of coal. For example, the coal feed to a known liquefaction process is typically treated by conventional coal cleaning methods to reduce its mineral matter content. The agglomeration of coal as used herein further reduces the mineral matter content of such conventionally cleaned coal by up to about 50 percent. The present invention utilizes the advantage of catalysis by impregnation of coal as illustrated in the examples below. Also by using oil agglomeration of the coal followed by water removal by draining, the problems associated with drying the catalyst-impregnated coal are significantly reduced. The present invention charges a highly concentrated feed of coal to the reactor thereby more efficiently using the reactor volume and energy for feed preheating than previously known direct liquefaction processes.

The invention will be further described with reference to the following examples.

EXAMPLE 1

Bituminous Illinois No. 6 coal (River King Mine) was pulverized to plant grind in which approximately 80 weight percent of the coal particulates passed through a 200 mesh screen (U.S. Sieve Series). Two series of reactions were carried out in small high pressure autoclaves that were heated by immersion in a fluidized sand bath and were continuously shaken during the reaction to achieve adequate mixing of the reactants. Reaction conditions common to all tests required conducting the reactions for a duration of 60 to 90 minutes at a reaction temperature of 427° C. Cold hydrogen pressure of 1200 psig yielded a calculated hydrogen pressure at reaction temperature of 2840 psig. In each reaction series, the coal was impregnated with ammonium paramolybdate catalyst from an aqueous solution and the coal was dried before the coal was placed in the reactor. Also, the reactions were carried out in the presence of varying amounts of solvent that was produced in the liquefaction of a bituminous coal. In the first reaction series, the concentration of molybdenum in the catalyst was 0.25 weight percent of dry coal and in the second series the concentration was 0.10 weight percent of dry coal. The THF solubility of the reaction products are listed in Table 1 below.

TABLE 1

Effect of Solvent on Coal Conversion

| wt. % coal in coal/solvent charge | THF conversion, wt. % maf coal |
|---|---|
| I. Catalyst concentration 0.25 wt. % Mo on mf coal | |
| 100 | 70 |
| 80 | 91 |
| 67 | 92 |
| 50 | 92 |
| 40 | 93 |
| II. Catalyst concentration 0.10 wt. % Mo on mf coal | |
| 100 | 36 |
| 80 | 92 |
| 67 | 92 |
| 50 | 92 |
| 40 | 92 |

As shown in Table 1, and as previously known, high conversion of bituminous coal can be achieved at moderate reaction conditions in the presence of small concentrations of molybdenum catalyst with or without solvent being present. However, Table 1 also shows two results that were not previously known. The first result was that a very significant increase in conversion was achieved, as compared to the liquefaction of coal without added solvent, when even a small amount of solvent (about 20 percent) was present. The second result was that when solvent was present with coal during the liquefaction reaction, no substantial increase in coal conversion was achieved if the solvent concentration was increased from 20 to 60 weight percent of the feed. This latter result suggests that if an impregnated catalyst is used, there would be no advantage, in terms of achieving high conversion of coal, to charge coal to a process in proportions of coal-to-solvent typical for conventional coal slurry feeds (c.a. 40 weight percent coal) instead of the much higher coal-to-solvent ratio used in the present invention. In the present invention, the small amount of solvent needed with the coal to provide desirable conversions in the continuous process is provided by the oil used in the agglomerate formation, and by the coal-derived liquids that are already present in the reactor when the fresh agglomerates fall into the liquid reaction medium within the reactor.

EXAMPLE 2

Bituminous Illinois No. 6 coal (Burning Star Mine) was pulverized in the same manner as the coal used in Example 1. The coal was subjected to liquefaction at four different values of hydrogen pressure. The reactions were carried out batchwise in a one liter stirred autoclave at 427° C. for 60 minutes. The coal was impregnated with 0.10 percent molybdenum as ammonium paramolybdate from an aqueous solution and was dried before being charged to the reactor. A solvent consisting of a liquefaction product of bituminous coal was charged to the reactor with the coal such that the coal provided 75 weight percent of the charge. The THF- and benzene-solubilities of the reaction products were measured and listed in Table 2.

TABLE 2

Effect of Hydrogen Partial Pressure on Conversion

| Total pressure at reaction temperature, psig | THF conversion, wt. % maf coal | Benzene Conversion wt. % maf coal |
|---|---|---|
| 1450 | 79 | 66 |
| 1800 | 90 | 82 |
| 2250 | 89 | 83 |
| 2750 | 91 | 89 |

Results in Table 2 show that relatively high THF-and benzene-conversions were obtained with small molybdenum concentrations and modest pressures under reaction conditions provided by the present invention.

EXAMPLE 3

A series of reactions was carried out with the same apparatus, coal, solvent, and coal/solvent charge composition as used in Example 2 except for the molybdenum catalyst which was at a lower concentration of 0.02 weight percent of dry coal. The effect of adding varying amounts of hydrogen sulfide to the hydrogen charged to the autoclave is shown in Table 3. All reactions were carried out at 427° C. for 60 minutes. The THF- and benzene-conversions were measured and listed in Table 3.

TABLE 3

Effect of Hydrogen Sulfide Partial Pressure on Conversion with Use of Molybdenum Catalyst

| Total pressure at reaction temperature, psig | $H_2S$ in $H_2$ charge, mole % | THF conversion, wt. % maf coal | Benzene conversion, wt. % maf coal |
|---|---|---|---|
| 2212 | 0 | 92 | 85 |
| 2184 | 1.0 | 94 | 87 |
| 2200 | 5.0 | 94 | 88 |

The results of Table 3 show that high conversions were achieved at very low concentrations of molybdenum catalyst under liquefaction conditions utilized by the present invention. As noted in this Table, the conversions were not materially affected by the presence of hydrogen sulfide at the reaction conditions used in this Example.

EXAMPLE 4

A series of reactions was carried out with the same apparatus, coal, solvent, and coal-solvent charge composition as used in Example 2. In this series an iron catalyst was used in the concentration of 1.0 weight percent iron based on dry coal. The catalyst was impregnated onto the coal from an aqueous solution of ferric sulfate heptahydrate and the coal was dried before being charged to the reactor. All reactions were carried out at 427° C. for 60 minutes. As in Example 3, the effect of varying amounts of hydrogen sulfide in the hydrogen charged to the autoclave is illustrated in Table 4. The THF- and benzene-conversions were measured and are listed in Table 4.

TABLE 4

Effect of Hydrogen Sulfide Partial Pressure on Conversion with Use of Iron Catalyst

| Total Pressure at reaction temperature, psig | $H_2S$ in $H_2$ charge, mole % | THF conversion, wt. % maf coal | Benzene conversion, wt. % maf coal |
|---|---|---|---|
| 2232 | 0 | 87 | 75 |
| 2247 | 1.0 | 89 | 79 |
| 2245 | 5.0 | 91 | 82 |

The results in Table 4 show that at reaction conditions of the invention, high conversions were obtained with iron which is a relatively inexpensive catalyst. Note that the presence of hydrogen sulfide improved the conversion as the concentration of the hydrogen sulfide increased.

EXAMPLE 5

A series of reactions was performed at 30 and 60 minute reaction times over a range of temperatures as listed in Table 5. The same apparatus, coal, solvent, and coal/solvent charge composition as used in Example 2, were employed. Hydrogen was used without hydrogen sulfide additions. Impregnated molybdenum salt catalyst was used at concentrations of 0.10 and 0.02 weight percent molybdenum on dry coal. The THF- and benzene-conversions were measured and are listed in Table 5.

TABLE 5

Effects of Reaction Temperature and Time on Conversion

| Total pressure at reaction temp., psig | Temp., °C. | Reaction time, min | Catalyst concentration, wt. % Mo | THF conversion wt. % maf coal | Benzene conversion, wt. % maf coal |
|---|---|---|---|---|---|
| 2212 | 427 | 60 | 0.02 | 92 | 85 |
| 2270 | 400 | 60 | 0.02 | 93 | 75 |
| 2256 | 385 | 60 | 0.02 | 93 | 73 |
| 2183 | 385 | 30 | 0.10 | 93 | 75 |
| 2413 | 370 | 60 | 0.10 | 92 | 63 |
| 2460 | 370 | 30 | 0.10 | 91 | 51 |
| 2354 | 360 | 60 | 0.10 | 93 | 60 |
| 2320 | 350 | 60 | 0.10 | 88 | 43 |
| 2375 | 350 | 30 | 0.10 | 90 | 42 |

The results in Table 5 illustrate that THF conversions of 90 percent were provided at reaction temperatures as low as 350° C. with the present invention and that reactivity was generally high as shown by high conversions at low reaction temperatures. Operability at low temperature is important because hydrocarbon gas make, an undesirable coproduct of coal hydrogenation, increases with reaction temperature.

EXAMPLE 6

Two batches of coal-oil agglomerates were prepared using coal as described in Example 2. The agglomerates were impregnated with catalyst and subsequently subjected to hydroliquefaction conditions. To form each batch of agglomerates, the following procedure was used. One hundred fifty grams of coal was added to 450 grams of water and agitated to form a slurry. To the slurry was added 2.46 g ammonium paramolybdate and stirred to dissolution. Fifty-two g of binder oil provided by a distillate derived from the liquefaction of bituminous coal was added to the slurry and the mixture was agitated for 30 minutes to form agglomerates of 1 to 3 mm nominal size. The oil content of the agglomerates was 35 percent by weight of the dry coal. The aqueous mixture containing the agglomerates was poured over a 20 mesh screen and agglomerates were retained on the screen. A small sample of agglomerates from each batch was removed and dried to determine their water content. It was determined that the first batch of agglomerates contained 17 weight percent water and the second batch contained 22 weight percent water. Therefore, the drained agglomerates retained the molybdenum catalyst in the amount of approximately 0.10 weight percent of dry coal. After collection on the screen, each batch of agglomerates (approximately 190 g) was transferred to a stirred one-liter autoclave at ambient temperature. Water was removed from the agglomerates by heating them to 90° C. while drawing a partial vacuum on the contents of the autoclave. Following the drying of the agglomerates, the autoclave was flushed, sealed, pressurized with hydrogen to 1300 psig, heated to a temperature of 427° C., and held for a duration of 60 minutes. In reacting the agglomerates, the average pressure at reaction temperature was 1880 psig for the first batch and 1967 psig for the second batch. The THF- and benzene-solubilities of the reaction products were measured and were found to be 93.5 weight percent and 89.1 weight percent, respectively, of maf coal for the first batch and 95.4 weight percent and 85.3 weight percent respectively for the second batch. This example demonstrates that coal-oil agglomerates, impregnated with catalyst and dried, can yield a favorable conversion when liquefied in accordance with the method of the present invention.

I claim:

1. A method for the hydrogenation of coal in a reactor operating at a pressure substantially greater than atmospheric pressure at elevated temperatures in the presence of a catalyst for converting the coal to hydrocarbon liquids and gases, comprising the steps of preparing an aqueous slurry of coal particulates, a water soluble catalyst and water with the water being in a sufficient amount to effect the dissolution of the catalyst and to provide the slurry with the sufficiently low viscosity to be mechanically pumped, adding an adequate amount of oil to the slurry to form agglomerates of the coal particulates, agitating the slurry to form the agglomerates, mechanically pumping the resulting slurry containing the agglomerates, excess water and unagglomerated solids to a pressure of at least about 1000 psig, separating the agglomerates from excess water and unagglomerated solids, passing the separated agglomerates through a dryer-preheater, contacting the agglomerates in the dryer-preheater with a stream of hot gas flowing countercurrently to the direction of flow of the agglomerates for drying the agglomerates, depositing the catalyst on the agglomerates and preheating the agglomerates prior to introduction thereof into a hydrogenation reactor, and thereafter contacting the coal particulates in the reactor with liquid reaction products and hot hydrogen to effect the hydrogenation of coal particulates at a pressure of at least about 1000 psig and a temperature in a range of about 340° to 450° C.

2. The method for the hydrogenation of coal as claimed in claim 1, wherein the sufficient concentration of water provides a coal-to-water slurry containing about 10 to 40 weight percent dry coal, and wherein the reactor pressure is in the range of about 1000 to 3500 psig.

3. The method for the hydrogenation of coal as claimed in claim 1, including the additional step of recycling of excess water separated from the agglomerates for use in the step of preparing the aqueous slurry.

4. The method for the hydrogenation of coal as claimed in claim 2 wherein the step of separating the agglomerates from the unagglomerated solids and excess water comprises conveying the slurry of coal-oil-catalyst agglomerates and water into a volume having screen means therein for retaining the agglomerates while providing for the flow of water and unagglomerated solids through the screen means.

5. The method for the hydrogenation of coal as claimed in claim 4 wherein said oil is derived from the hydrogenation of coal, wherein said adequate amount of oil is in the range of about 5 to 35 weight percent based on the weight of the dry coal in the slurry, and wherein the agglomerates are in a size range of about 1 to 4 mm.

6. the method for the hydrogenation of coal as claimed in claim 4 wherein the step of passing the agglomerates through the dryer-preheater into the reactor is provided by vertically orienting the dryer-preheater and dropping the agglomerates therethrough into the reactor.

7. The method for the hydrogenation of coal as claimed in claim 6 wherein the hot gas contacting the agglomerates in the dryer-preheater is provided by the stream of gas of primarily hydrogen for heating the agglomerates to a temperature in the range of about 190° to 350° C.

8. the method for hydrogenation of coal as claimed in claim 7, wherein up to about 20 mole percent hydrogen sulfide is added to the hot hydrogen in the reactor for effecting the hydrogenation reaction.

* * * * *